US007396437B2

(12) United States Patent
Shead et al.

(10) Patent No.: US 7,396,437 B2
(45) Date of Patent: Jul. 8, 2008

(54) METHOD AND SYSTEM FOR CONTROLLING THE WEB FORMATION

(75) Inventors: Raymond P. Shead, Harrietsharn (GB); Johann Moser, Heidenheim (DE)

(73) Assignee: Voith Paper Patent GmbH, Heisenheim (DE)

( * ) Notice: Subject to any disclaimer, the term of this patent is extended or adjusted under 35 U.S.C. 154(b) by 842 days.

(21) Appl. No.: 10/374,071

(22) Filed: Feb. 27, 2003

(65) Prior Publication Data

US 2003/0205347 A1 Nov. 6, 2003

(30) Foreign Application Priority Data

Mar. 1, 2002 (EP) ..... 02004784

(51) Int. Cl.
*D21F 11/00* (2006.01)

(52) U.S. Cl. ..... 162/198; 162/263; 162/300; 162/352; 162/49; 700/127; 700/128; 700/129; 700/142

(58) Field of Classification Search ..... 162/198, 162/263, 300, 301, 302, 352, 49; 700/127, 700/128, 129, 122, 142
See application file for complete search history.

(56) References Cited

U.S. PATENT DOCUMENTS

| | | | | |
|---|---|---|---|---|
| 3,655,980 | A | 4/1972 | Bossen | |
| 3,813,283 | A | 5/1974 | Urbas | |
| 4,990,784 | A | 2/1991 | Dukes et al. | |
| 5,505,819 | A * | 4/1996 | De Witt et al. | 162/142 |
| 5,798,024 | A | 8/1998 | Odell et al. | |
| 5,871,617 | A | 2/1999 | Iwata et al. | |
| 6,092,003 | A | 7/2000 | Hagart-Alexander et al. | |
| 6,319,362 | B1 * | 11/2001 | Huhtelin et al. | 162/198 |
| 6,521,089 | B1 | 2/2003 | Griech et al. | |
| 6,551,459 | B1 * | 4/2003 | Lumiala et al. | 162/198 |
| 2003/0089479 | A1 * | 5/2003 | Griech et al. | 162/263 |

FOREIGN PATENT DOCUMENTS

| | | |
|---|---|---|
| EP | 0735184 | 10/1996 |
| EP | 0853703 | 7/1998 |
| EP | 1054102 | * 11/2000 |
| GB | 1279152 | 6/1972 |
| WO | 99/64963 | 12/1999 |

* cited by examiner

*Primary Examiner*—Mark Halpern
(74) *Attorney, Agent, or Firm*—Greenblum & Bernstein, P.L.C.

(57) ABSTRACT

Method and system for controlling web formation in the forming section of a paper machine includes measuring the amount of white water occurring during drainage in at least one drainage region of the forming section; and carrying out the web formation control on the basis of the white water measurement.

15 Claims, 2 Drawing Sheets

METHOD AND SYSTEM FOR CONTROLLING THE WEB FORMATION

CROSS-REFERENCE TO RELATED APPLICATIONS

The present application claims priority under 35 U.S.C. §119 of European Patent Application No. 02004784.1, filed on Mar. 1, 2002, the disclosure of which is expressly incorporated by reference herein in its entirety.

BACKGROUND OF THE INVENTION

1. Field of the Invention

The present invention relates to a method and a system for controlling web formation in the forming section of a paper machine.

2. Discussion of Background Information

The traditional way of measuring drainage in the forming section is to use a backscatter gamma gauge. As this instrument measures the fabric weight, fiber weight and water weight, it is necessary to manually determine the thinstock consistencies between the machine direction measurement points in order to calculate the water weight difference. The main drawback with such a device relates to the portability of its ionizing gamma radiation source within mills and across national borders. Often this sensor cannot be transported in an aircraft.

Alternative measurement techniques have been used by which water can be measured without using an ionizing source. In particular, ultrasonic sensors have been used. However, such an ultrasonic measurement may not work beyond the dryer line and cannot work in situations where the stock contains over 0.75% air content on a volumetric basis. As a consequence, this technique is not considered acceptable.

It is therefore an object of the present invention to provide an improved method and an improved system of the kind initially mentioned with which the above-mentioned problems can be eliminated.

SUMMARY OF THE INVENTION

The present invention relates to a method for controlling web formation in a forming section of a paper machine, comprising:

measuring the amount of white water occurring during drainage in at least one drainage region of the forming section, and carrying out the web formation control on the basis of the white water measurement.

In accordance with a preferred practical embodiment of the method of the invention, the amount of white water occurring over the and/or over at least one predetermined drainage path is measured, and said web formation control is carried out on the basis of the resulting drainage development.

Preferably, said white water measurement is carried out at different successive locations of the predetermined drainage part.

In accordance with another expedient practical embodiment of the method of the invention, a plurality of adjustable forming blades is used, and the drainage development is controlled via the control of the pressure applied to the adjustable forming blades. Pressure tubes can be associated with the adjustable forming blades. In the latter case, the pressure in the pressure tubes is controlled.

The adjustable forming blades are preferably used in combination with support blades or foil blades arranged in opposed relationship to the adjustable forming blades.

A former with such adjustable forming blades is described in U.S. Pat. No. 5,798,024 and its family member EP-B-0 853 703. Generally, the respective former can be such as described in this U.S. Pat. No. 5,798,024 and its family member EP-B-0 853 703, which are incorporated herein by reference in their entireties.

Thus, the respective former can especially comprise a pulsating pressure mechanism for producing a pulsating effect on the web, with the pulsating pressure mechanism comprising a support member arranged in one of the wire loops and including support blades in operative engagement with the wire, and a drainage and loading member arranged in the other one of the wire loops and including adjustable loading blades arranged in opposed relationship to the support blades and in operative engagement with the wire. Apart from this, the respective former can, for example, be a roll and blade gap former having first and second wires guided each in a respective loop and defining a twin-wire forming zone, a forming gap in which the first and second wires converge before the twin-wire zone, a headbox including a slice channel having a slice opening through which a stock suspension jet is fed into the forming gap to form a web between the wires, a first forming roll defining in part the forming gap, a run directing mechanism which directs a run of the twin-wire zone after the forming gap in a curve over a wrap angle sector of the first forming roll and the pulsating pressure mechanism on the web after the curved run of the twin-wire zone over the wrap angle sector of the first forming roll.

However, the invention is not restricted to gap-forming headboxes but could also be applied to, for example, top formers if they too were equipped with pressure blades.

The white water measurement and/or the web formation control can be carried out sectionally. In particular, the white water measurement and/or the web formation control can be carried out sectionally, preferably as regarded in machine cross direction.

Preferably, at least one actual drainage curve representing the drainage development is derived from the measured values.

In an expedient practical embodiment, a plurality of support blades or foil blades is used and a respective actual drainage curve is derived by subtracting the water weight measured between each pair of successive support blades or foil blades.

In accordance with a preferred practical embodiment of the method of the invention data derived from the white water measurement and representing at least one actual drainage curve are compared using a controller with data representing at least one ideal drainage curve, and the web formation control is carried out dependent on the result of the comparison.

Preferably, the web formation control comprises restoring the data representing the actual drainage curve to the data representing the ideal drainage curve.

The data representing the at least one ideal drainage curve can be stored in the controller or associated storage mechanism in advance.

Generally, it is possible to provide different ideal drainage curves corresponding to different web or paper graves.

In accordance with an expedient embodiment of the method of the invention, at least one microwave sensor is used for carrying out the drainage measurement.

Such a microwave sensor is, for example, available from Falmouth, Cornwall, UK. The respective sensor has a footprint which is about 15 cm×10 cm (×5 cm deep). The sensor available from Falmouth is mounted on a broomhandle connected to a battery-powered portable analyser for use on the machine. No mains power is required. The respective sensor should, however, be embodied in the respective control system.

As to the available sensor, the following aspects are to be considered:

The sensor has a single microwave resonance to infer water weight and does not use a reference chamber. The used sensor should provide long-term accuracy and stability.

It includes an integral temperature sensor to correct the measurement due to friction heating between it and the forming fabric.

The measurement is sensitive to both fiber and water. Therefore, an optical senor, or preferably a plurality of optical sensors can be used to determine a ratio relationship between fiber and water. This ratio of fiber to water can be applied to the microwave sensor in order to enhance for accuracy of the sensor. It is especially useful to include a plurality of optical consistency sensors when the microwave sensor comprises an embedded solution, i.e., forms an installation as part of the apparatus as compared to being portable, such as being hand-held, which embedded solution is preferred.

The sensor preferably has a wide pH range, and the above-noted microwave sensor has been successfully used over the pH range of 4.5-8.0.

The long-term effect of dirt accumulation on the measurement window has not been considered for embedded solutions. However, hand-held trials have not exhibited any problems.

To provide for contacting measurement, as noted above, it is preferred to use an as an embedded measurement.

The frequency response of the above-noted microwave sensor is not known. However, respective measurement should be able to be used in conjunction with machine monitoring equipment to determine high-frequency disturbances at the wet end emanating from rotating elements up-to-and including the former section plus constructive wave-forms between the foils.

Drainage trials have been performed across the complete trade range using this sensor. It has been used on, for example, gap-forming headboxes as well as conventional fourdriniers without damaging the forming fabrics.

As to technical issues, one of the main issues relates to the long-term accuracy of the intended measurement considering it does not utilize a reference chamber. This may be acceptable for hand-held devices which can be checked prior to each measurement. However, any embedded measurement, which is preferred in connection with the present invention, needs to operate accurately and reliably for up to one year without requiring any maintenance. Sensor wear and dirt accumulation of the available sensor are again unknown and important for the preferred embedded solutions. They are not so important for hand-held devices. A measurement response frequency needs to be established if the respective measurement is to prove valuable as an embedded solution for trouble-shooting forming section. Repeatable, accurate, reliable drainage measurement is required in order to evaluate and optimize the forming section in terms of forming fabrics, foils and controls.

Apart from the use of such sensors on a number of machines making different grades or forming techniques (examples: newsprint/gap former, recycled/fourdrinier, fine/fourdrinier), the use of a fixed sensor would be expedient.

The use of such a microwave technology as part of an embedded solution for drainage measurement and control on new machines and for the after-market is preferred.

Generally, also other types of sensors can be used, for example, a gamma gauge.

Alternatively, water removal during drainage could, for example, also be determined by using flow measurements taken from adjacent foil trays positioned in the forming zone on either side of the forming fabrics. This would provide a simpler, more reliable measurement of dewatering and would negate the requirement for contacting sensors in a hostile environment.

In accordance with the invention, the above-mentioned object is further satisfied by the provision of a system for controlling the web formation in the forming section of a paper machine, the said system comprising a white water measurement system for measuring the amount of white water occurring during drainage in at least one drainage region of the forming section; and a controller for carrying out the web formation control on the basis of the white water measurement.

According to the present invention, drainage measurement is provided as part of a preferably embedded control solution for all paper machines. The drainage measurement is used to optimize formation, strength, drainage curves and machine speed including the ability to provide controls designed to improve operating efficiencies. As an embedded solution, it would provide a unique technology for different formers.

A measured drainage curve can be derived by subtracting the water weight measured between each foil blade. A target drainage "array" for each grade can be entered. This array would reflect the ideal drainage curve which gave best dewatering and final formation. A controller can be provided which compares the target drainage array against the current array and provides a control signal to restore the measured value to the target array. The array output can be sent to the backing foil pressure tubes to control the drainage in the forming section.

Thus, the present invention provides a method for controlling web formation in a forming section of a paper machine, comprising measuring an amount of white water occurring during drainage in at least one drainage region of the forming section; and carrying out web formation control on a basis of the white water measurement.

Moreover, the present invention provides a system for controlling web formation in a forming section of a paper machine, the system comprising a measuring system for measuring an amount of white water occurring during drainage in at least one drainage region of the forming section; and a controller for carrying out web formation control on a basis of the white water measurement.

The measuring an amount of white water can comprise measuring the amount of white water occurring over at least one of time and over at least one predetermined drainage path, and the web formation control can be carried out on the basis of the resulting drainage development.

The white water measurement can be carried out at different successive locations of the predetermined drainage path.

A plurality of adjustable forming blades can be used, and the drainage development can be controlled via control of pressure applied to the adjustable forming blades.

The adjustable forming blades can be used in combination with support blades or foil blades arranged in opposed relationship to the adjustable forming blades.

At least one of the white water measurement and the web formation control can be carried out sectionally.

At least one of the white water measurement and the web formation control can be carried out sectionally with respect to the machine cross direction.

At least one actual drainage curve representing the drainage development can derived from the measured values.

A plurality of support blades or foil blades can be used and a respective actual drainage curve can be derived by subtracting the water weight measured between each pair of successive support blades or foil blades.

Data derived from the white water measurement and representing at least one actual drainage curve can be compared using a controller with data representing at least one ideal drainage curve, and the web formation control can be carried out dependent on the result of the comparison.

The web formation control can comprise restoring the data representing the actual drainage curve to the data representing the ideal drainage curve.

The data representing the at least one ideal drainage curve can be stored in the controller or associated storage system in advance.

Different ideal drainage curves corresponding to different web or paper grades can be provided.

At least one microwave sensor can be used for carrying out the measuring an amount of white water occurring during drainage.

Measuring an amount of white water occurring during drainage in at least one drainage region of the forming section can include taking flow measurements from adjacent foil trays positioned in the forming zone on either side of the forming fabrics.

The measuring system can comprise at least one microwave sensor.

The measuring system can comprise flow measurement elements for taking flow measurements from adjacent foil trays positioned in the forming zone on either side of the forming fabrics.

A plurality of adjustable forming blades can be provided and the controller can control the pressure applied to the adjustable forming blades for controlling the drainage development.

Pressure tubes can be associated with the adjustable forming blades, and the pressure in the pressure tubes can be controlled by the controller.

Other exemplary embodiments and advantages of the method and system of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
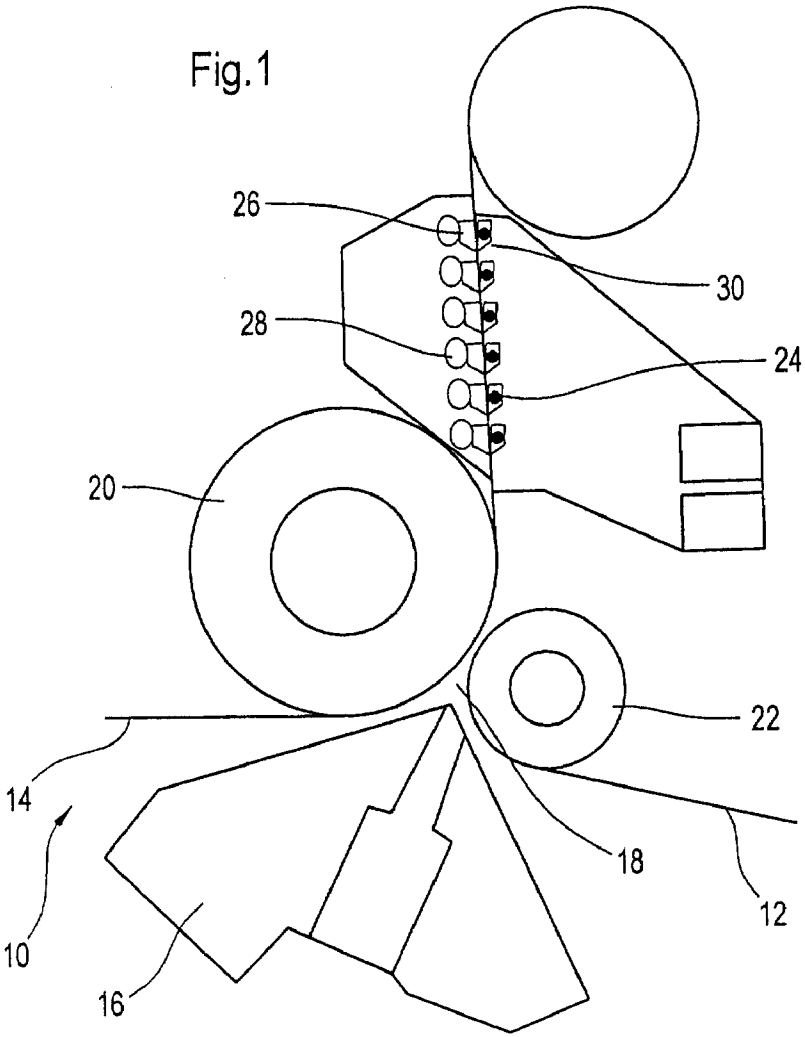
FIG. 1 is a schematic part illustration of a twin-wire former including adjustable forming blades.

FIG. 1 shows a schematic part illustration of a twin-wire former 10. The former 10 comprises two wires 12, 14 which define a twin-wire zone.

A stock suspension jet delivered by a headbox 16 is fed into a wedge-shaped forming web 18 defined between the two converging wires 12, 14.

A forming roll 20 is arranged inside the loop of the wire 14, and a breast roll 22 is disposed inside the loop of the other wire 12.

A measuring system 24 for measuring the amount of white water occurring during drainage in the twin-wire zone is provided. In the present case, this measurement system 24 includes a water weight measurement system.

A plurality of adjustable forming blades 26 is provided inside the loop of the wire 14. Pressure tubes 28 are associated with the adjustable forming blades 26.

The adjustable forming blades 26 are used in combination with support blades or foil blades 30 arranged inside the loop of wire 12 in opposed relationship to the adjustable forming blades 26.

Figure 2:
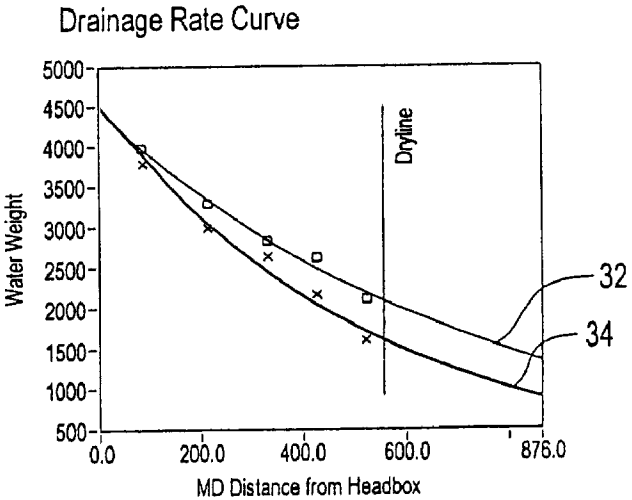
FIG. 2 is a graphic illustration showing an exemplary measured drainage rate curve and an exemplary target or ideal drainage rate curve.

In the graphic illustration of FIG. 2, an exemplary measured drainage rate curve 32 and an exemplary target or ideal drainage rate curve 34 is shown. In the graphic illustration the water weight (lbs/ream) is depicted over the Direction (MD) distance (inches) from headbox 16.

Figure 3:
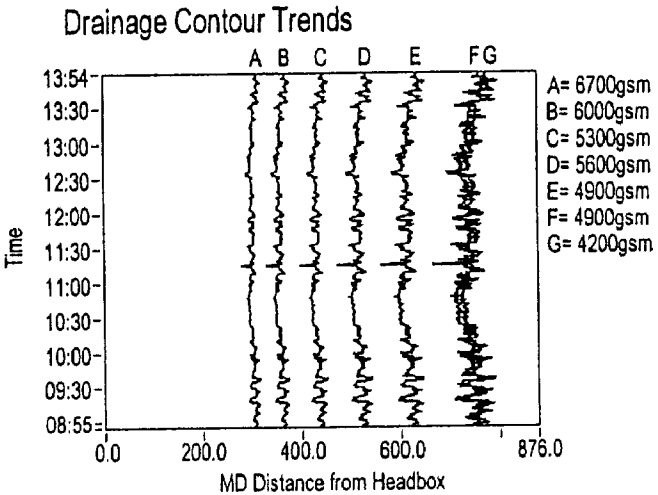
FIG. 3 is a graphic illustration showing exemplary drainage contour trends for different grades.

FIG. 3 is a graphic illustration showing exemplary drainage contour trends for different web or paper grades.

Figure 4:
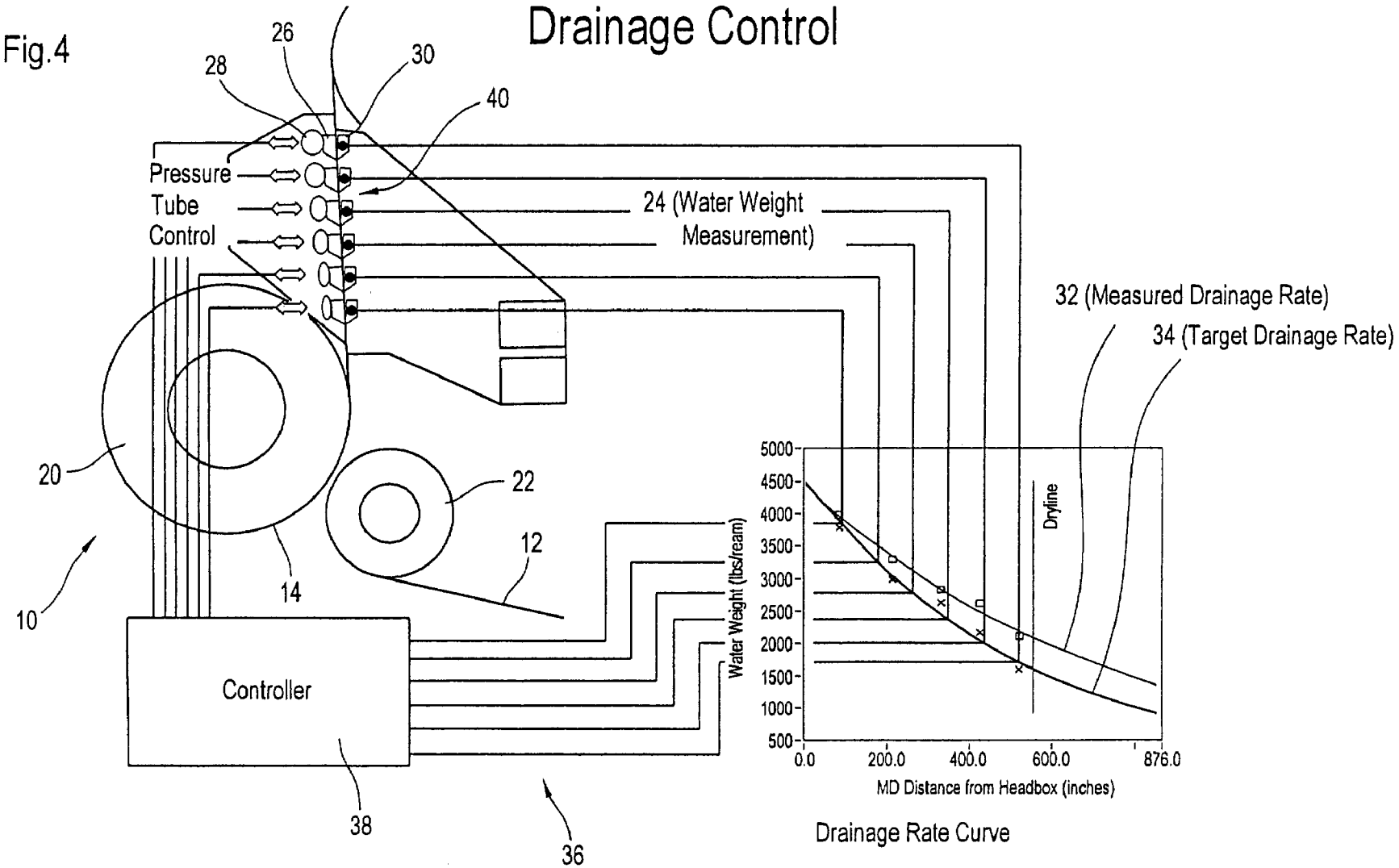
FIG. 4 is a schematic illustration of an exemplary embodiment of a web formation control system.

FIG. 4 shows a schematic illustration of an exemplary embodiment of a web formation control system 36. The former 10 as shown in this FIG. 4 is of the same kind as that of FIG. 1. Like features are associated with like reference numerals.

A controller 38 is provided for carrying out web formation control on the basis of the white water measurement.

The measuring system 24 comprises, for example, at least one microwave sensor.

The controller 38 controls the pressure applied to the adjustable forming blades 26 for controlling the drainage development. The pressure in the pressure tubes 28 associated with the adjustable forming blades 26 is controlled by the controller 38.

The measuring system 24 is used to measure the amount of white water occurring over time and/or over the twin-wire zone defining a predetermined drainage path 40.

Web formation control is carried out using the controller 38 on the basis of the resulting drainage development.

As can be seen from FIG. 4, the white water measurement is carried out at different successive locations of the predetermined drainage path 40. The drainage development is controlled via the control of pressure applied to the adjustable forming blades 30.

The white water measurement and/or the web formation control can be carried out sectionally, in particular as regarded in machine cross direction.

At least one actual drainage curve 32 representing the drainage development is derived from the values measured by the measurement system 24. A respective actual drainage curve 32 can, for example, be derived by subtracting the water weight measured between each pair of successive support blades or foil blades 30.

Data derived from the white water measurement and representing at least one actual drainage curve 32 are compared using the controller 38 with data target or ideal drainage curve 34. The web formation control is carried out by using the controller 38 dependent on the result of the comparison.

The graph in FIG. 4 showing the drainage rate curve is identical with the graph of FIG. 2.

The web formation control as carried out by the controller 38 comprises comparing the data representing the actual drainage curve 32 to the data representing the ideal drainage curve 34.

The data representing the at least one ideal drainage curve can be stored in the controller 38 or associated storage system in advance. Different ideal drainage curves corresponding to different web or paper blades may be provided.

As mentioned above, the measuring system 24 can, for example, comprise at least one microwave sensor.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE NUMERAL LIST

| | |
|---|---|
| 10 | Former |
| 12 | Wire |
| 14 | Wire |
| 16 | Headbox |
| 18 | Gap forming roll |
| 22 | Breast roll |
| 24 | Measuring system |
| 26 | Adjustable forming blades |
| 28 | Pressure tube |
| 30 | Support blade or foil blade |
| 32 | Measured drainage rate curve |
| 34 | Ideal drainage rate curve |
| 36 | Web formation control system |
| 38 | Controller |
| 40 | Drainage path, twin-wire zone |

What is claimed is:

1. A method for controlling web formation in a forming section of a paper machine, comprising:

measuring an amount of white water occurring during drainage in at least one drainage region of the forming section; and carrying out web formation control on a basis of the white water measurement.

2. The method in accordance with claim 1, wherein the measuring an amount of white water comprises measuring the amount of white water occurring over at least one of time and over at least one predetermined drainage path, and said web formation control is carried out on the basis of the resulting drainage development.

3. The method in accordance with claim 2, wherein the white water measurement is carried out at different successive locations of said predetermined drainage path.

4. The method in accordance with claim 1, wherein a plurality of adjustable forming blades is used, and in that the drainage development is controlled via control of pressure applied to said adjustable forming blades.

5. The method in accordance with claim 4, wherein said adjustable forming blades are used in combination with support blades or foil blades arranged in opposed relationship to said adjustable forming blades.

6. The method in accordance with claim 1, wherein at least one of the white water measurement and said web formation control is carried out sectionally.

7. The method in accordance with claim 6, wherein at least one of the white water measurement and said web formation control is carried out sectionally with respect to the machine cross direction.

8. The method in accordance with claim 1, wherein at least one actual drainage curve representing the drainage development is derived from the measured values.

9. The method in accordance with claim 1, wherein a plurality of support blades or foil blades is used and a respective actual drainage curve is derived by subtracting the water weight measured between each pair of successive support blades or foil blades.

10. The method in accordance with claim 1, wherein data derived from the white water measurement and representing at least one actual drainage curve are compared using a controller with data representing at least one ideal drainage curve, and said web formation control is carried out dependent on the result of said comparison.

11. The method in accordance with claim 10, wherein different ideal drainage curves corresponding to different web or paper grades are provided.

12. The method in accordance with claim 10, wherein the web formation control comprises restoring the data representing said actual drainage curve to the data representing said ideal drainage curve.

13. The method in accordance with claim 10, wherein the data representing said at least one ideal drainage curve are stored in said controller or associated storage system in advance.

14. The method in accordance with claim 1, wherein at least one microwave sensor is used for carrying out the measuring an amount of white water occurring during drainage.

15. The method in accordance with claim 1, wherein measuring an amount of white water occurring during drainage in at least one drainage region of the forming section includes taking flow measurements from adjacent foil trays positioned in a forming zone on either side of forming fabrics.

* * * * *